US006935208B1

(12) United States Patent
Cruthirds

(10) Patent No.: US 6,935,208 B1
(45) Date of Patent: Aug. 30, 2005

(54) BOTTLE OPENER RESEMBLING A DIVING LURE

(76) Inventor: Stephen W. Cruthirds, 64223 Tumalo Rim Dr., Bend, OR (US) 97701

( * ) Notice: Subject to any disclaimer, the term of this patent is extended or adjusted under 35 U.S.C. 154(b) by 16 days.

(21) Appl. No.: 10/271,066

(22) Filed: Oct. 15, 2002

Related U.S. Application Data

(60) Provisional application No. 60/329,295, filed on Oct. 15, 2001.

(51) Int. Cl.[7] ..... B67B 7/16
(52) U.S. Cl. ..... 81/3.55; 7/106
(58) Field of Search ..... 81/3.55, 3.09, 81/3.47, 3.4, 3.57; D8/40; D22/133; 7/106, 7/151

(56) References Cited

U.S. PATENT DOCUMENTS

| | | | | | |
|---|---|---|---|---|---|
| 278,951 | A | | 6/1883 | Hartman | |
| 637,048 | A | | 11/1899 | Toulotte | |
| D41,984 | S | * | 11/1911 | Sommer | 81/3.55 |
| 2,010,326 | A | | 8/1935 | Schuchardt | 65/46 |
| 2,829,432 | A | | 4/1958 | Haslett | 30/16 |
| D184,822 | S | | 4/1959 | Mann | D85/2 |
| D187,708 | S | * | 4/1960 | Author | D8/38 |
| 4,183,164 | A | * | 1/1980 | Young et al. | 43/42.09 |
| 4,215,507 | A | * | 8/1980 | Russell | 43/42.22 |
| 4,520,696 | A | * | 6/1985 | Wolze | 81/3.55 |
| D279,645 | S | * | 7/1985 | Markis | D8/38 |
| 4,979,407 | A | * | 12/1990 | Hernandez et al. | 81/3.09 |
| D334,696 | S | | 4/1993 | Makris | D8/38 |
| 5,337,632 | A | * | 8/1994 | Thomas et al. | 81/3.55 |
| D382,784 | S | * | 8/1997 | Kagiyama et al. | D8/40 |
| D393,993 | S | | 5/1998 | De Bergen | D8/43 |
| 5,829,965 | A | | 11/1998 | Rubalcava | 431/253 |
| D406,025 | S | | 2/1999 | Hung | D8/38 |
| D421,373 | S | | 3/2000 | Hollinger | D8/42 |
| D421,559 | S | | 3/2000 | Hollinger | D8/105 |
| 6,142,769 | A | | 11/2000 | Walker | 431/253 |
| D437,025 | S | | 1/2001 | Peck | D22/133 |
| D451,774 | S | * | 12/2001 | Kelleghan | D8/38 |
| D479,967 | S | * | 9/2003 | Schulein | D8/40 |

FOREIGN PATENT DOCUMENTS

| | | |
|---|---|---|
| GB | 2080880 | 5/1999 |
| WO | WO 88/03512 | 5/1988 |

* cited by examiner

*Primary Examiner*—Lee D Wilson
(74) *Attorney, Agent, or Firm*—Cox Smith Matthews Incorporated

(57) ABSTRACT

A bottle opener comprises a fish-shaped body with a loop-type bottle cap remover depending from the mouth of the fish-shaped body such that the bottle opener resembles a diving lure, which is particularly attractive to fishermen. Alternatively, the fish-shaped body may be provided with a bill and a lifting tab spaced apart from the bill. The fish-shaped body preferably has a gently curved dorsal surface that comfortably fits into the palm of a user's hand for easy grasping and use. To further resemble a diving lure, treble hooks or the like may be attached to the body by conventional eyelets. Such hooks preferably have rounded ends and have no barbs in order to avoid punctures or cuts to the user. Conventional metal hooks may be dipped in a liquid plastic, rubber, or similar material that cures to form a resilient coating for safe handling.

13 Claims, 4 Drawing Sheets

BOTTLE OPENER RESEMBLING A DIVING LURE

CROSS-REFERENCE TO RELATED APPLICATION

This application claims priority from U.S. Provisional Application Ser. No. 60/329,295 filed on Oct. 15, 2001.

BACKGROUND OF THE INVENTION

1. Field of the Invention

This invention relates generally to an apparatus for opening bottled beverages, and more particularly to a bottle opener that resembles a diving lure used for fishing.

2. Description of the Related Art

Several types of manual bottle openers are known in the art, including bottle openers having a corkscrew and a knife blade such as the device described in U.S. Pat. No. 637,048 to Toulotte, which is incorporated herein by reference. Other examples of known bottle openers include those described in U.S. Pat. Nos. 278,951, 2,010,326, 2,829,432, 5,829,965, 6,142,769, D184,822, D334,696, D393,993, D406,025, D421,373, D421,559, and D437,025, each of which is also incorporated herein by reference. However, with the exception of U.S. Pat. Nos. 2,010,326, D184,822, D334,696, D406,025, and D421,559, the foregoing bottle openers generally do not incorporate aesthetically attractive design features with the functional features of the bottle opener. More particularly, except for U.S. Patent Nos. D184,822 and D334,696, none of the foregoing known bottle openers incorporates design features that would be particularly attractive to fishermen. The D184,822 patent discloses a tool having an ash tray, a can and bottle opener, and a fish scaler in the general shape of a fish that would presumably be attractive to fishermen, but that tool has numerous sharp and pointed protrusions which would present cutting hazards to people and other equipment when the tool is not in use. Similarly, the D334,696 patent discloses a bottle opener having an overall shape that resembles a shark, which presumably would be attractive to fishermen, but the D334,696 bottle opener has several pointed protrusions which would present puncture hazards to people and other equipment when the tool is not in use. Such protrusions also make the tool more difficult to grasp during use. Another drawback of the D334,696 bottle opener is that it is quite thin, which also makes it more difficult to grasp during use.

In view of the foregoing limitations and drawbacks, there is a need in the art for a bottle opener that is attractive to fishermen, easy to handle, and does not have exposed sharp or pointed protrusions which present safety hazards to the user.

SUMMARY OF THE INVENTION

To solve the aforementioned and other problems, a bottle opener in accordance with the present invention preferably comprises a fish-shaped body with a loop-type bottle cap remover depending from the mouth of the fish-shaped body such that the bottle opener resembles a diving lure, which is particularly attractive to fishermen. Alternatively, instead of a loop-type bottle cap remover, the bottle opener may have a bill for engaging the top of a bottle cap and a lifting tab beneath the bill for engaging the lower edge of a bottle cap. The fish-shaped body preferably has a gently curved dorsal surface that comfortably fits into the palm of a user's hand for easy grasping and use. To further resemble a diving lure, treble hooks or the like may be attached to the fish-shaped body by conventional eyelets or other suitable attachment means. Such hooks preferably have rounded ends and have no barbs in order to avoid punctures or cuts to the user. To achieve that objective, conventional metal hooks may be dipped in a liquid plastic, rubber, or similar material that cures to form a resilient coating for safe handling.

It is an object of the present invention to provide a bottle opener with a fish-shaped body that is particularly attractive to fishermen.

It is another object of this invention to provide a bottle opener that resembles a diving lure used for fishing.

It is yet another object of this invention to provide a bottle opener with a fish-shaped body that fits comfortably in the palm of a user's hand and is easy to grasp.

It is still another object of the present invention to provide an attractive, fish-shaped bottle opener that does not have sharp or pointed protrusions.

Further objects and advantages of the present invention will be readily apparent to those skilled in the art from the following detailed description taken in conjunction with the annexed sheets of drawings, which illustrate a preferred embodiment of the invention.

DETAILED DESCRIPTION OF A PREFERRED EMBODIMENT

Figure 1:
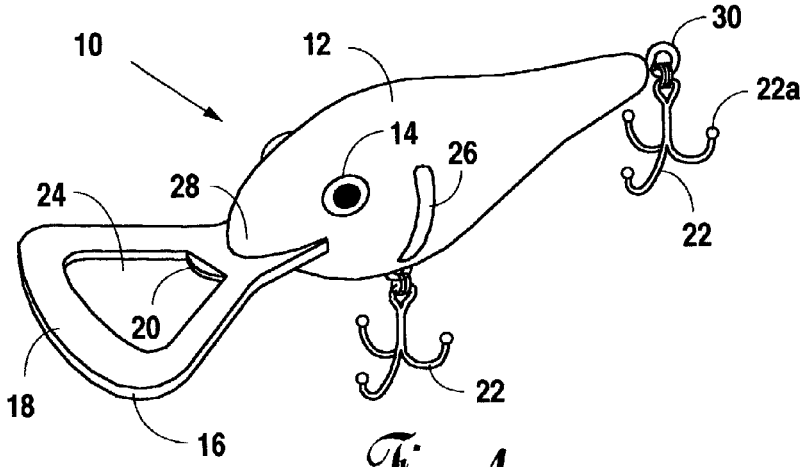
FIG. 1 is a perspective view of a bottle opener in accordance with the present invention.
Figure 2:
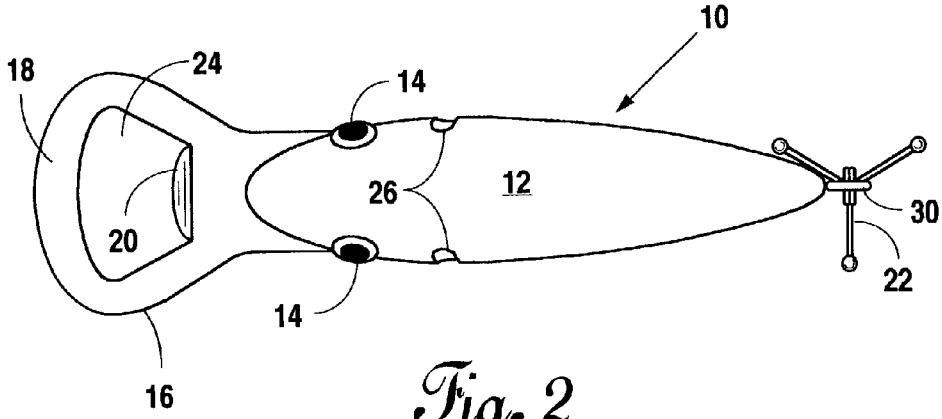
FIG. 2 is a top view of the bottle opener of FIG. 1.
Figure 3:
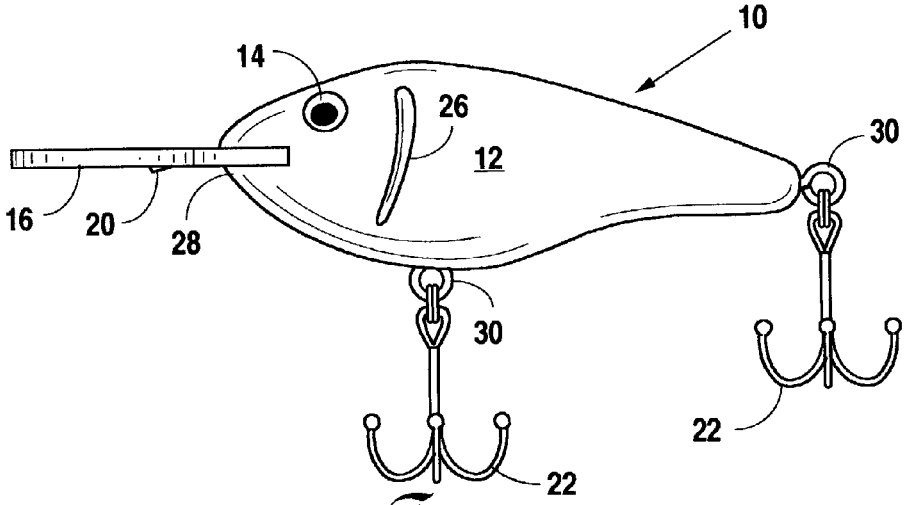
FIG. 3 is a left side view of the bottle opener of FIG. 1.
Figure 4:
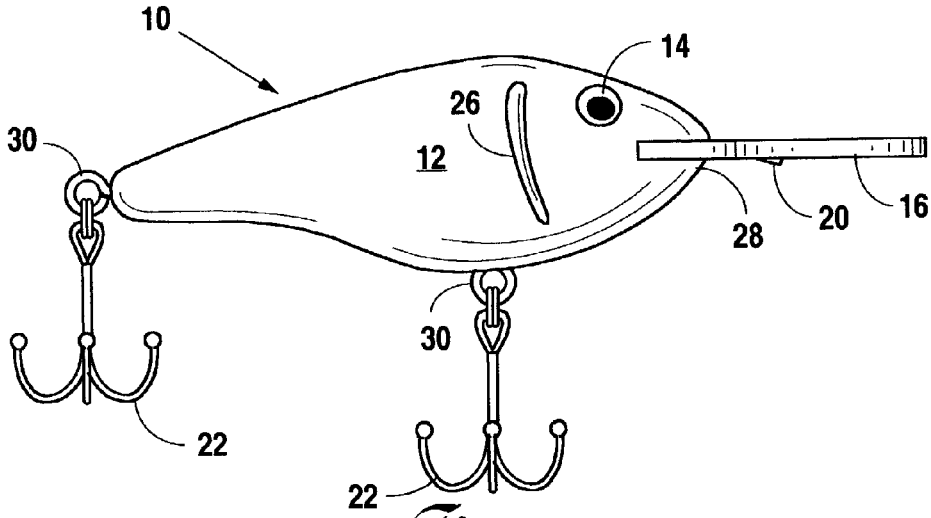
FIG. 4 is a right side view of the bottle opener of FIG. 1.
Figure 5:
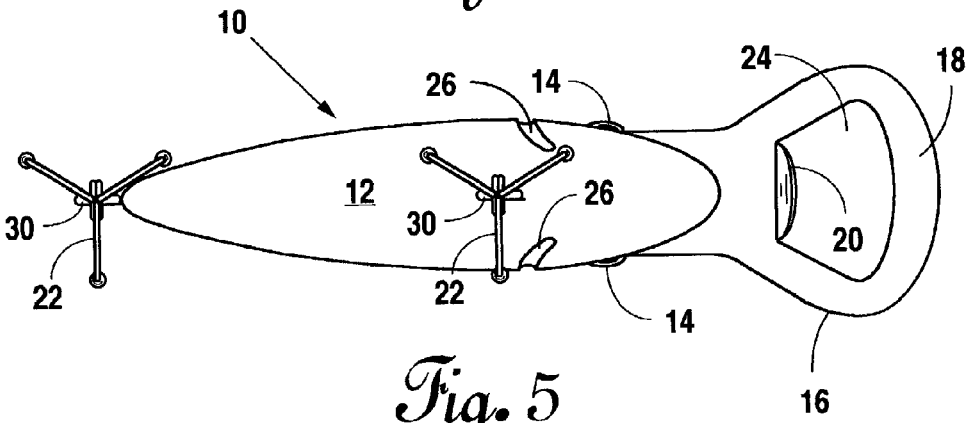
FIG. 5 is a bottom view of the bottle opener of FIG. 1.
Figure 6:
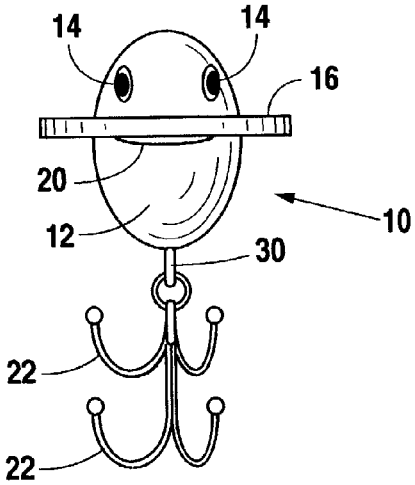
FIG. 6 is a front view of the bottle opener of FIG. 1.
Figure 7:
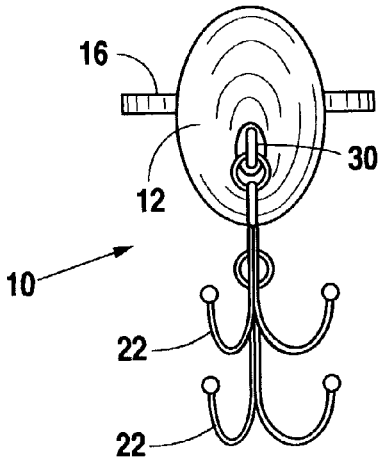
FIG. 7 is a rear view of the bottle opener of FIG. 1.

Referring to FIGS. 1–7, a bottle opener 10 in accordance with the present invention preferably comprises a fish-shaped body 12 with a loop-type bottle cap remover 16 depending from the mouth 28 of the fish-shaped body 12 such that bottle opener 10 resembles a diving lure used for fishing. The fish-shaped body 12 preferably has a gently curved dorsal surface that comfortably fits into the palm of a user's hand for easy grasping and use. The fish-shaped body 12 is preferably molded from relatively rigid plastic, but it may be made of any other suitable material, such as metal, wood, fiberglass, or ceramic. Bottle cap remover 16 is preferably a conventional, metal, loop-type bottle cap remover fixedly mounted or embedded in mouth 28. Alternatively, bottle cap remover 16 may be integral with the fish-shaped body 12. Bottle cap remover 16 has a hole 24 bounded by a forward edge 18 and a rear tab 20, which is connected to forward edge 18 by a pair of sides to form a loop. Although bottle cap remover 16 is preferably made of metal, it may also be made of any other suitably stiff material. As shown in FIGS. 1, 3, 4, 6, and 7, preferably bottle cap remover 16 is generally flat except for tab 20, which is angled slightly downward. As shown in FIGS. 1, 2, and 5, bottle cap remover 16 preferably has an outer shape comprising an arcuate and fairly broad forward edge 18 with sides that taper to about the same width as body 12 near mouth 28. However, the shape of bottle cap remover 16 and hole 24 may vary as desired. As is known in the art, bottle cap remover 16 is positionable about a bottle cap on a beverage bottle (not shown) such that forward edge 18 engages the top of the bottle cap and tab 20 engages the bottom edge of the bottle cap. By applying an upward force on body 12 and thereby lifting the rear end of bottle cap remover 16, the bottle cap may be removed from the bottle. Bottle opener 10 preferably has eyes 14 and indentations or protrusions 26 resembling gills positioned on body 12. Other indicia of fish, such as fins (not shown), may also be provided. Additionally, bottle opener 10 preferably has one or more hooks 22, such as conventional treble hooks, mounted on body 12 with eyelets 30 or other suitable attachment means so that bottle opener 10 further resembles a fishing lure. Hooks 22 preferably have rounded ends 22*a* and no barbs so as to avoid cutting and puncture hazards. Hooks 22 may be conventional metal hooks that are dipped in a liquid plastic, rubber, or similar material that cures to form a resilient protective coating (not shown) to cover and smooth over any sharp or pointed protrusions for safe handling. Hooks 22 may also be made of other nonmetal material, such as plastic.

Figure 8:
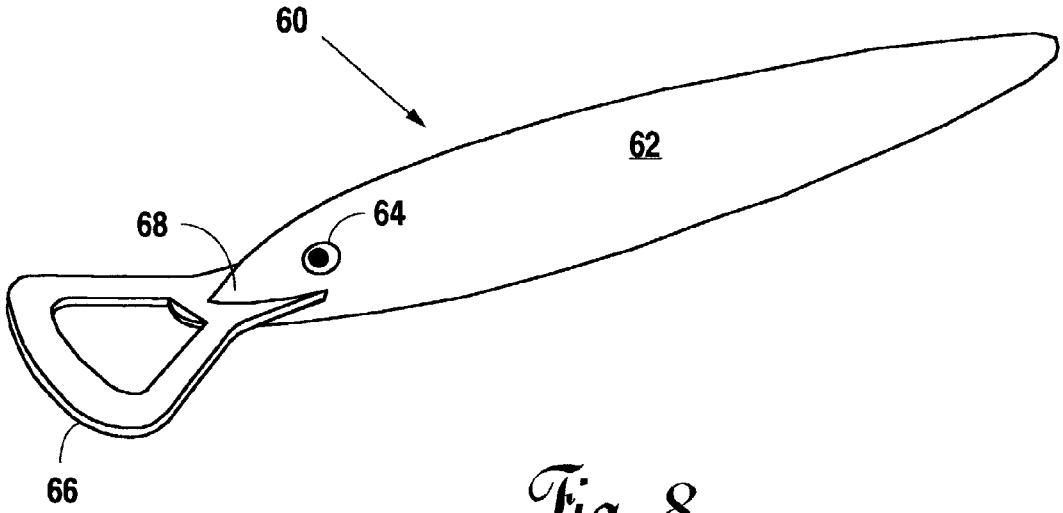
FIG. 8 is a perspective view of an alternative bottle opener in accordance with the present invention.

Alternatively, as shown in FIG. 8, an alternative bottle opener 60 may not have any hooks for the sake of simplicity and added safety. Like bottle opener 10 described above, bottle opener 60 has a fish-shaped body 62 with eyes 64 and a loop-type bottle cap remover 66 depending from mouth 68. It will be apparent to those skilled in the art that the size and shape of the fish-shaped body of a bottle opener in accordance with the present invention may vary considerably.

Figure 9:
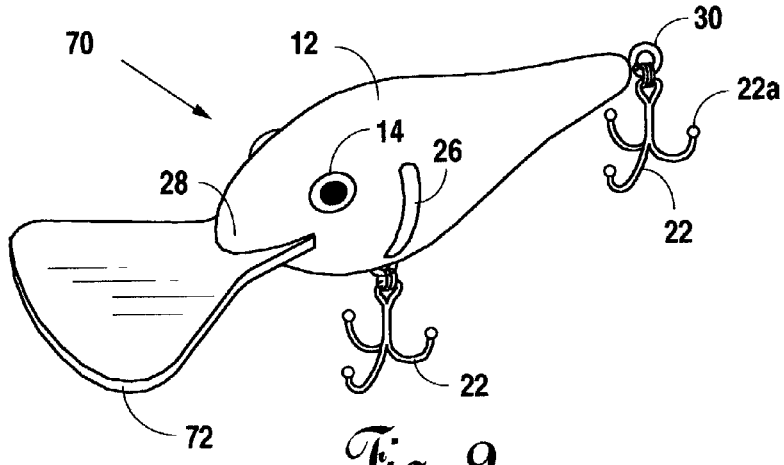
FIG. 9 is a perspective view of another alternative bottle opener in accordance with the present invention.
Figure 10:
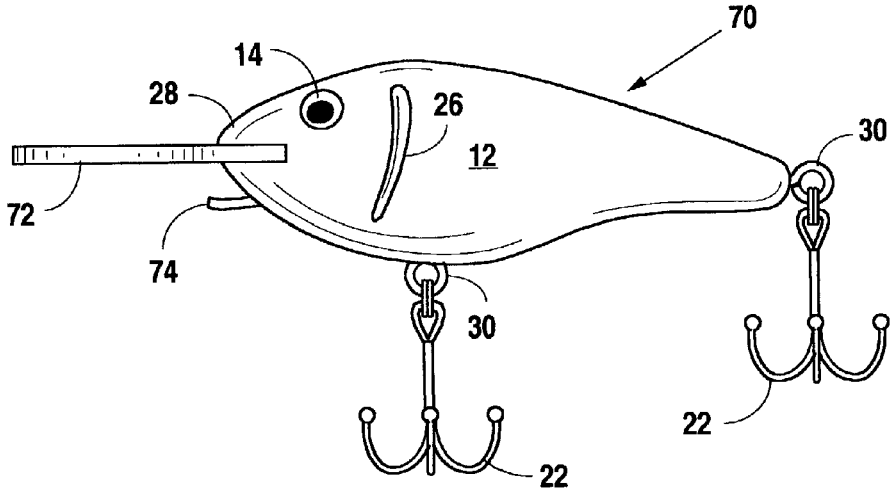
FIG. 10 is a left side view of the bottle opener of FIG. 9.
Figure 11:
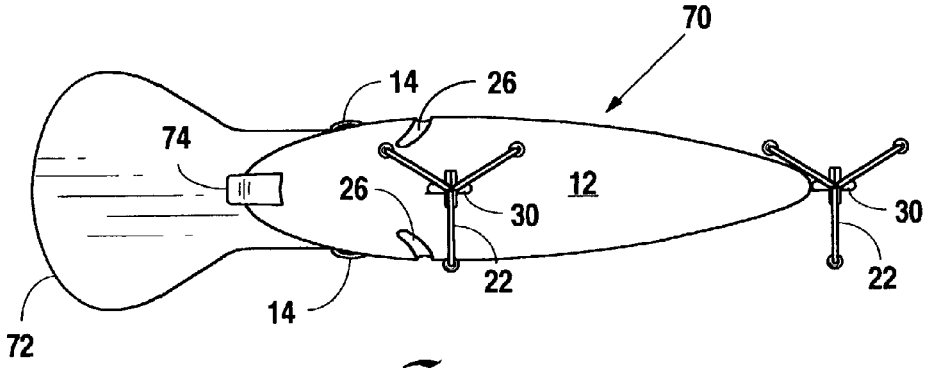
FIG. 11 is a bottom view of the bottle opener of FIG. 9.

Referring to FIGS. 9–11, another alternative bottle opener 70 is shown having a fish-shaped body 12. Rather than a loop-type bottle cap remover, bottle opener 70 has a bill 72 depending from the mouth 28 of the fish-shaped body 12 such that bottle opener 70 resembles a diving lure used for fishing. For simplicity, bill 72 is illustrated as being generally planar, but bill 72 may have curvature if desired. A lifting tab 74 extends from body 12 beneath bill 72. Bill 72 and lifting tab 74 preferably are relatively rigid and are fixedly attached to or embedded in body 12. Alternatively, bill 72 and lifting tab 74 may be integral to body 12. Bill 72 and lifting tab 74 are preferably made of metal but may also be made of other suitably stiff material. Bottle opener 70 is positionable about a bottle cap on a beverage bottle (not shown) such that bill 72 engages the top of the bottle cap and lifting tab 74 engages the bottom edge of the bottle cap. When bottle opener 70 is so positioned about the bottle cap, applying an upward force on body 12 causes the bottle cap to be removed from the bottle. Bottle opener 70 preferably has eyes 14, indentations or protrusions 26 resembling gills, and hooks 22 connected to body 12 with eyelets 30 as discussed above in connection with bottle opener 10. The outer shape of bill 72 is preferably similar to that of bottle cap remover 16 as described above such that bottle opener 70 resembles a diving type fishing lure.

Although the foregoing specific details describe a preferred embodiment of this invention, persons reasonably skilled in the art will recognize that various changes may be made in the details of this invention without departing from the spirit and scope of the invention as defined in the appended claims. Therefore, it should be understood that this invention is not to be limited to the specific details shown and described herein.

I claim:

1. A bottle opener comprising:

a fish-shaped body having a mouth; and a loop-type bottle cap remover depending from said mouth; and at least one hook depending from said body.

2. The bottle opener of claim 1 wherein said at least one hook comprises a treble hook.

3. The bottle opener of claim 1 wherein said at least one hook comprises a resilient coating.

4. The bottle opener of claim 1 wherein said at least one hook comprises at least one rounded end.

5. A bottle opener for removing a bottle cap from a bottle, the bottle cap having a top and a lower edge, said bottle opener comprising:

a fish-shaped body having a mouth, said body being engageable by hand, a loop-type bottle cap remover depending from said mouth, said bottle cap remover being generally flat and comprising a hole bounded by a forward edge having a first width, a rear tab having a second width which is smaller than said first width, and tapered sides connecting said forward edge to said rear tab; and at least one hook depending from said body, said at least one hook having a resilient coating and at least one rounded end;

wherein said bottle cap remover is positionable about the bottle cap with said forward edge engaging the top of the bottle cap and said rear tab engaging the lower edge of the bottle cap such that manual application of sufficient upward fore to said body will remove the bottle cap from the bottle.

6. The bottle opener of claim 5 wherein said forward edge is accurate.

7. The bottle opener of claim 5 wherein said rear tab is angled downward.

8. A bottle opener comprising:

a fish-shaped body having a mouth;

a bill extending from said mouth;

a lifting tab extending from said body in spaced relation to said bill; and at least one hook depending firm said body.

9. The bottle opener of claim 8 wherein said at least one hook comprises a treble hook.

10. The bottle opener of claim 8 wherein said at least one hook comprises a resilient coating.

11. The bottle opener of claim 8 wherein said at least one hook comprises at least one rounded end.

12. A bottle opener comprising:

a fish-shaped body having a mouth;

a bill extending from said mouth; and a lifting tab extending from said body in spaced relation to said bill;

wherein said bill is generally planar.

13. A bottle opener comprising:

a fish-shaped body having a mouth;

a bill extending from said mouth; and a lifting tab extending from said body in spaced relation to said bill;

wherein said bill has curvature.

* * * * *

UNITED STATES PATENT AND TRADEMARK OFFICE

CERTIFICATE OF CORRECTION

PATENT NO. : 6,935,208 B1
DATED : August 30, 2005
INVENTOR(S) : Stephen W. Cruthirds It is certified that error appears in the above-identified patent and that said Letters Patent is hereby corrected as shown below:

Title page,
Item [56], References Cited, U.S. PATENT DOCUMENTS, replace "D41,984" with -- D41,894 --; and
"D279,645" reference, replace "Markis" with -- Makris --.

Column 4,
Line 17, after "hand," replace comma with a semicolon.
Line 31, replace "fore" with -- force --.
Line 34, replace "accurate" with -- arcuate --.
Line 42, replace "firm" with -- from --.

Signed and Sealed this

Twenty-eighth Day of March, 2006

JON W. DUDAS
*Director of the United States Patent and Trademark Office*